US005732584A

United States Patent [19]

Prater et al.

[11] Patent Number: 5,732,584

[45] Date of Patent: Mar. 31, 1998

[54] METHOD AND APPARATUS FOR ROLL FORMING CONVOLUTED SPRINGS

[75] Inventors: Larry Paul Prater, Taylor; Richard Paul Stoynoff, Woodhaven, both of Mich.

[73] Assignee: Livernois Research & Development Company, Dearborn, Mich.

[21] Appl. No.: 705,414

[22] Filed: Aug. 29, 1996

[51] Int. Cl.[6] ..... B21D 13/04

[52] U.S. Cl. ..... 72/187; 72/196

[58] Field of Search ..... 72/187, 196

[56] References Cited

U.S. PATENT DOCUMENTS

| | | | |
|---|---|---|---|
| 1,143,735 | 6/1915 | Slick | 72/252.5 |
| 1,741,907 | 12/1929 | Beck | 72/187 |
| 4,507,948 | 4/1985 | Wallis | 72/185 |
| 4,608,845 | 9/1986 | Campbell | 72/196 |
| 4,838,065 | 6/1989 | Wallis | 72/185 |
| 5,261,262 | 11/1993 | Wallis | 72/185 |

FOREIGN PATENT DOCUMENTS

| | | | |
|---|---|---|---|
| 192824 | 7/1990 | Japan | 72/187 |
| 243222 | 10/1991 | Japan | 72/187 |

*Primary Examiner*—Lowell A. Larson
*Attorney, Agent, or Firm*—Brooks & Kushman P.C.

[57] ABSTRACT

An apparatus for roll forming convoluted springs in which a tempered steel strip is fed between a pair of forming rolls which produce a continuous convoluted steel strip. A compression mechanism downstream of the pair of forming rolls compresses the continuous convoluted steel strip to set the angular relationship of the adjacent legs of the convoluted steel strip. A cut-off mechanism disposed downstream of the compression mechanism device severs from the convoluted strip individual convoluted springs having a predetermined number of convolutions and desired spring characteristics.

28 Claims, 6 Drawing Sheets

METHOD AND APPARATUS FOR ROLL FORMING CONVOLUTED SPRINGS

TECHNICAL FIELD

The invention is related to the field of making convoluted springs and, in particular, to a method and apparatus for roll forming convoluted springs.

BACKGROUND ART

One-way clutches are used in a variety of power transmission systems to limit power transmission in one direction. These devices inhibit powertrains from being driven in the reverse direction due to unexpected reversals of the power source, such as when the engine of an automotive vehicle backfires. Typically, one-way clutches embody helical springs which bias rotary pins in a direction to inhibit rotation of an inner race relative to an outer race in a predetermined direction. In some embodiments of these one-way clutches, the helical springs are replaced with serpentine-shaped or convoluted springs.

The prior art teaches that these convoluted springs can be manufactured by expensive and complicated mechanisms having severe production limitations. Stamping and four-slide manufacturing devices have been used to produce these types of springs but these methods result in production inadequacies.

The invention is directed to the use of roll forming technology to produce convoluted springs of the type required for one-way clutches.

Roll forming technology has been used in the past to produce serpentine-shaped fins for heat exchangers such as used in automotive engine cooling systems and air conditioning systems as taught by Wallis in U.S. Pat. Nos. 4,507,948 and 4,838,065. This technology was applied to corrugating relatively soft metals, such as aluminum and aluminum alloys, but not to spring-type tempered steels.

DISCLOSURE OF THE INVENTION

The invention is a method and apparatus for roll forming convoluted springs from a strip of deformable material. The deformable material may be steel, aluminum, plastic, or any other material from which a spring may be formed. The apparatus has a pair of spring forming rolls having a common region of mutual contact. The spring forming rolls have a set of teeth which interleave with each other at the common region of intersection. The teeth in each forming roll are contoured to convolute the strip of deformable material as it passes between them to continuously form a convoluted strip. The spring forming rolls are driven in opposite rotational directions to pull the strip from a coil or any other suitable source and produce a continuous convoluted strip. A compression mechanism such as an external resistance device compresses the convoluted strip so that in a relaxed state after compression, adjacent legs of the convoluted metal strip will have a predetermined angular relationship. A cut-off mechanism downstream of the compression mechanism severs the continuous convoluted strip to produce individual convoluted springs.

One object of the invention is to mass produce convoluted springs using roll forming technology.

Another object of the invention is to form the individual convoluted springs from a continuous strip of deformable resilient material.

It is another object of the invention to compress the convoluted strip after roll forming so that adjacent legs of the convoluted strip have a predetermined angular relationship.

Still another object of the invention is to cut the continuous convoluted strip at predetermined locations to form individual convoluted springs.

Yet another object of the invention is to produce convoluted springs at a lower cost and a rate substantially higher than the prior art.

These and other objects of the invention will become more apparent from a reading of the detailed description of the best mode in conjunction with the drawings.

BEST MODE FOR CARRYING OUT THE INVENTION

Figure 1:
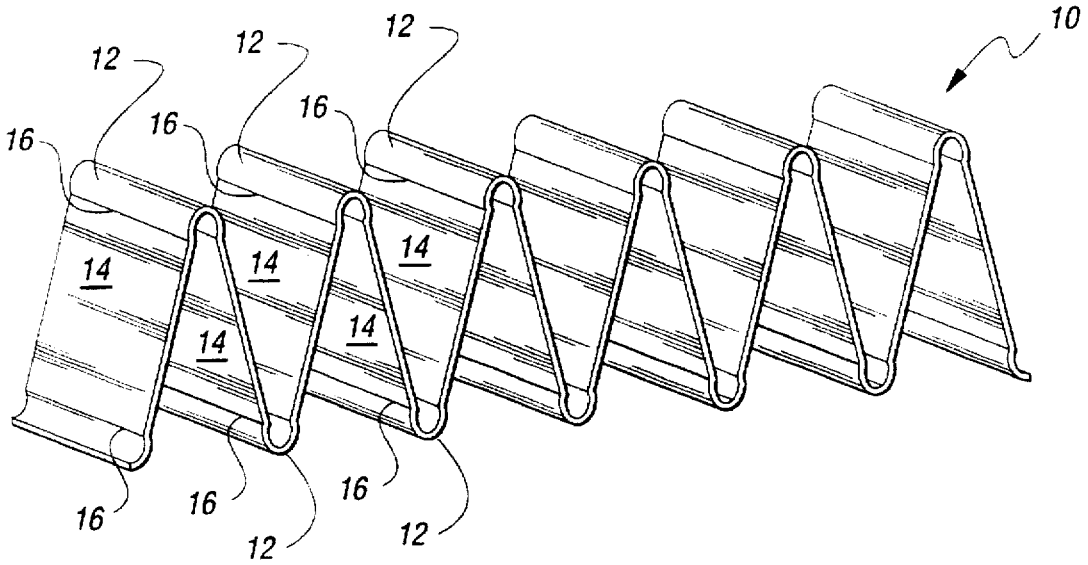
FIG. 1 is a perspective view of a convoluted spring.

A spring 10 of the type made by the spring making apparatus of this invention is shown in FIG. 1. This type of spring is known as a serpentine or convoluted spring having "U" shaped crown 12 provided at crests of each convolution connected by legs 14. The spring 10 shown in FIG. 1, has a secondary transverse breakline 16 is provided at the junction between the U-shaped crowns 12 and the legs 14 to control deformation of the spring upon compression.

Figure 2:
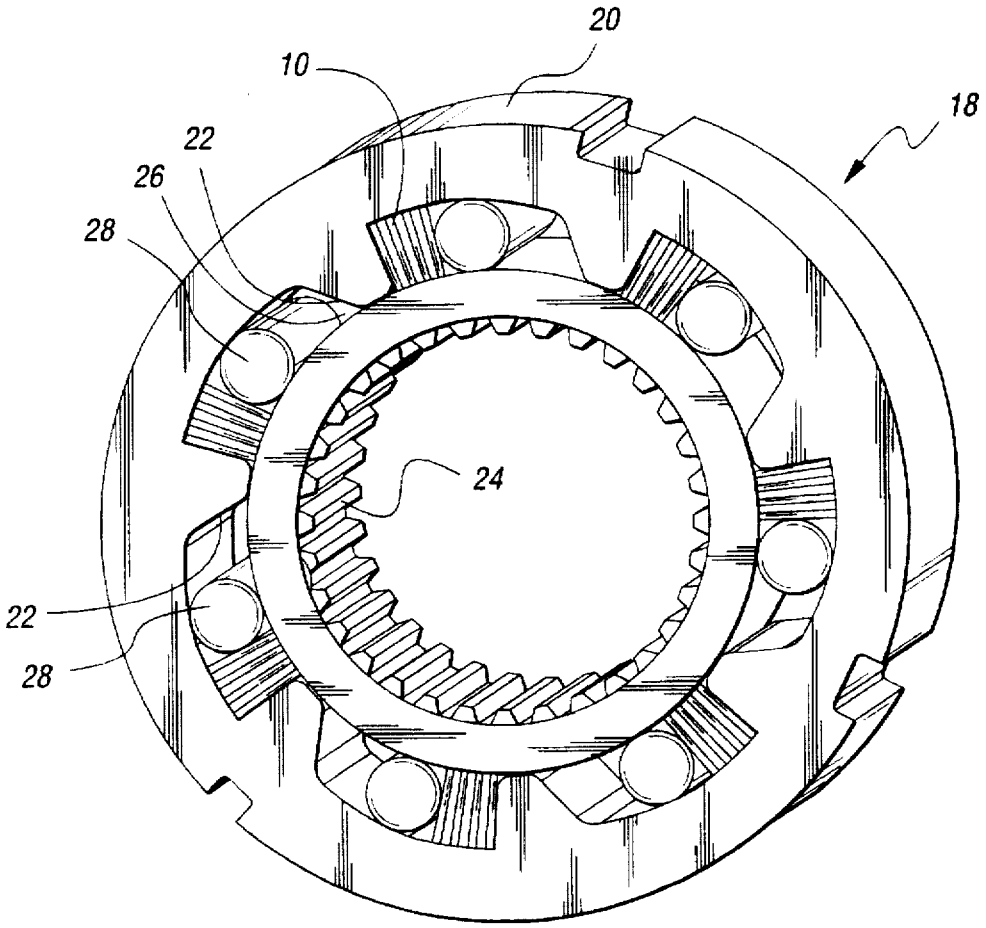
Fig. 2 (PRIOR ART)
FIG. 2 is a perspective of a one-way clutch embodying convoluted springs.

One intended use of such convoluted springs 10 is in a one-way clutch 18 as shown in FIG. 2. The one-way clutch has an outer race 20 having a plurality of cut-outs 22 and an inner race 24. The cut-outs 22, in conjunction with the inner race 24, form a plurality of tapered chambers 26. A cylindrical pin 28 disposed in each tapered chamber 26 is biased by a convoluted spring, such as convoluted spring 10, toward the narrower portion of the tapered chamber 26. As is known in the art of one-way clutches, this arrangement will allow the inner race 24 to freely rotate relative to the outer race 20 in only one direction.

Figure 3:
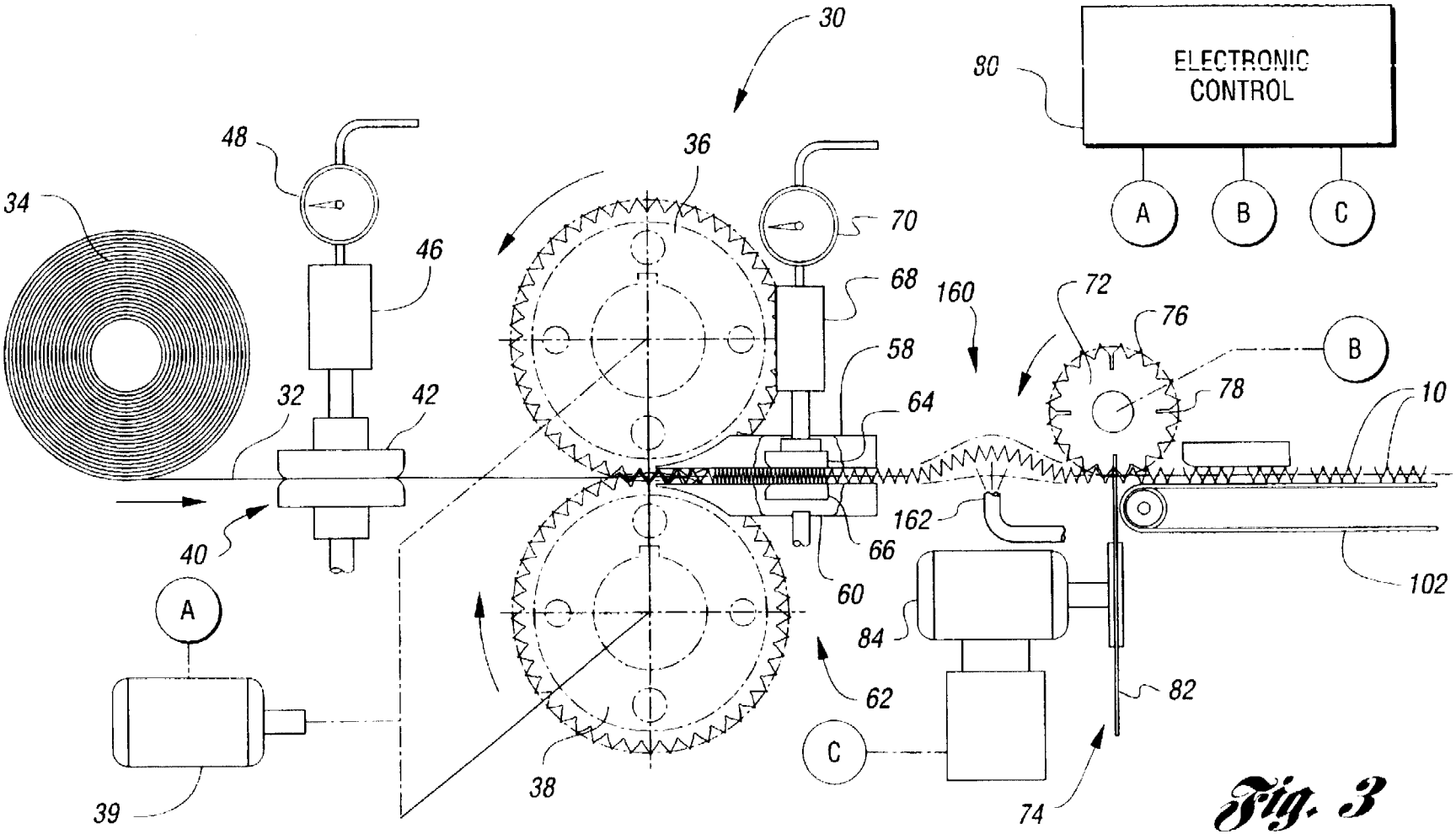
FIG. 3 is a side view of a first embodiment of the spring forming apparatus.

The details of a spring making apparatus 30 for making convoluted springs are shown in FIG. 3. A strip of resilient deformable material 32 to be formed into the spring 10 is extracted from a coil 34 by a pair of mating form rolls 36 and 38 disposed on opposite sides of the strip 32. The forming rolls 36 and 38 are driven in opposite directions by a motor 39 to pull the strip 32 from the coil 34. A tension device 40, such as a pair of pressure pads 42 and 44, is disposed between the coil containing the strip of resilient material 32 and the forming rolls 36 and 38. The tensioning device 40 aligns the metal strip 32 with the forming rolls and places a predetermined tension on the metal strip 32 as it is pulled by the forming rolls 36 and 38 therethrough.

The strip of resilient material 32 is preferably a tempered high grade steel strip such as 303 or 304 stainless steel having an O2 temper, but may be made from any other metal or alloy used in the fabrication of springs or even a plastic material. In the embodiment of the one-way clutch 18 illustrated in FIG. 2, the strip of resilient material 32 is a 303 steel strip having a thickness of approximately 0.075 mm (0.003 inches). However, the thickness of the strip 32 is not limited to this thickness, and different thicknesses may be used to obtain a desired spring characteristic for the convoluted spring.

The tension on the strip 32 produced by the pads 42 and 44 is controlled by a pneumatic cylinder 46 receiving pressurized air from an external source (not shown) through a pressure regulator 48. Although in the embodiment shown, the tensioning device 40 is a pair of pneumatically actuated friction pads, it is recognized that many other types of tensioning devices, known in the art, may alternatively be used in place thereof.

Figure 6:
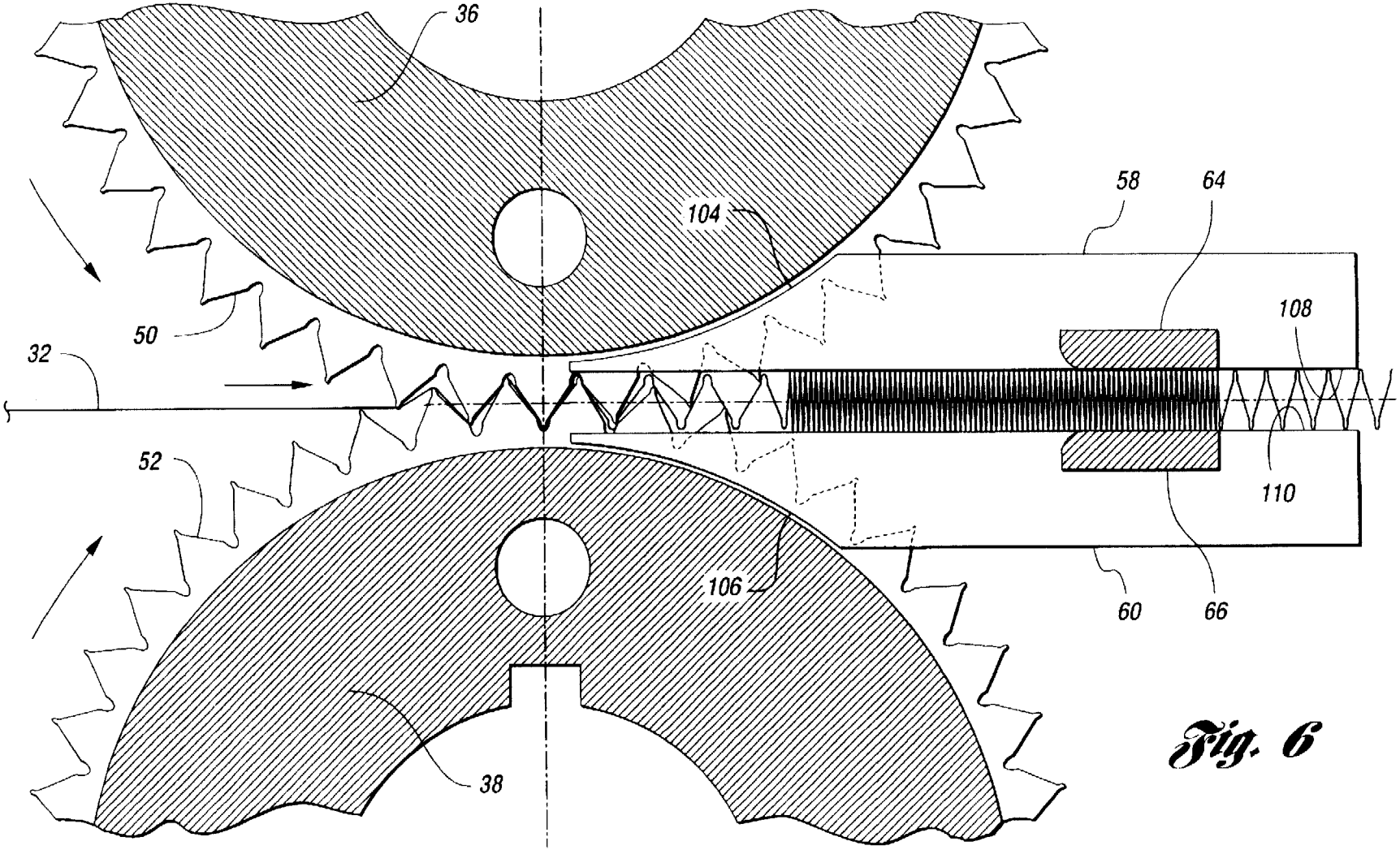
FIG. 6 is an enlarged partial cross-section showing the details of the spring forming roll teeth and the stripper fingers.

Each of the forming rolls 36 and 38 have a plurality of teeth 50 and 52 as more clearly shown in FIG. 6. The teeth 50 and 52 interleave at a common region of their engagement with the strip 32 and convolute the strip as it passes therebetween.

Figure 5:
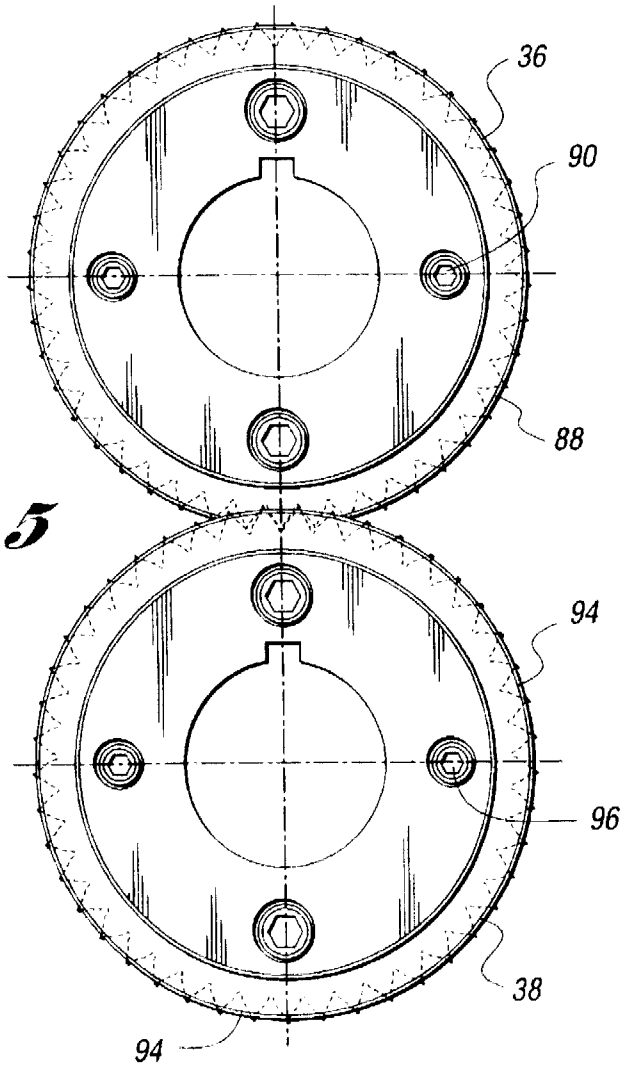
FIG. 5 is a side view of the pair of spring forming rolls.
Figure 4:
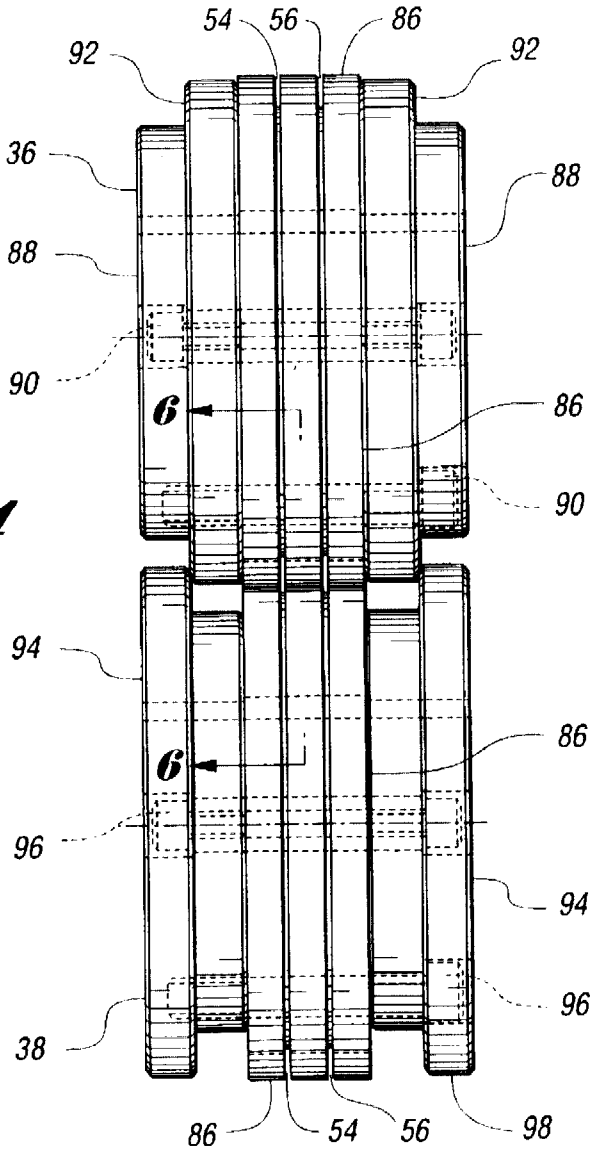
FIG. 4 is an end view of the pair of spring forming rolls.

As shown more clearly in FIGS. 4 and 5, the rolls 36 and 38 each have at least one annular slot, such as slots 54 and 56, into which stripper fingers 58 and 60 are inserted to strip the convoluted strip 32 from the forming rolls 36 and 38. The stripper fingers 58 and 60 also guide and support the convoluted strip as it exits from between the rolls 36 and 38 as shown in FIG. 3. These stripper fingers 58 and 60, as more clearly shown in FIG. 6, support and contain the convoluted strip as it is compressed by compression mechanism 62 illustrated as a second pair of compression pads 64 and 66. These compression pads 58 and 60 provide an impedance to the flow of the convoluted strip 32 and cause the convolutions of the convoluted strip to be set so that in their relaxed state, the adjacent legs 14 will have a predetermined angular relationship to each other as shown in FIG. 1. The force between the compression pads 64 and 66, as shown in FIG. 3, is controlled by a pneumatic cylinder 68 receiving pressurized air from an external source, not shown, through a pressure regulator 70 to obtain the desired compression of the convoluted strip. As an alternative, the external resistance device may be a spring finger or a packing roll, as is known in the art.

The convoluted strip 32 is extracted from the compression mechanism 62 by a cutting wheel 72 of a cutting mechanism 74. The cutting wheel 72 has a plurality of teeth 76 which are received between adjacent crests of the convoluted strip 32. Slots 78 are provided in the cutting wheel at predetermined teeth intervals determined by the desired number of convolutions in the finished spring. The rotation of the cutting wheel 72 is controlled by an electrical control 80 to stop when each slot 78 is aligned with the cutting blade 82 of a saw mechanism 84. Each time the cutting wheel 72 is stopped, the saw mechanism 84 is reciprocated so that the convoluted strip is cut into successive sections of desired length to form individual convoluted springs 10.

The severed springs 10 are transported away from the cutting device 74 to a container or packaging station, not shown, by a conveyor 102. The stopping of the cutting wheels 72 and the reciprocation of the saw mechanism 84 are coordinated by the electrical control 80.

For high speed production rates, a hump station 160 may be provided between the compression mechanism 62 and the cutting mechanism 72. The hump station 160 permits the forming rolls 36 and 38 to run continuously in spite of the intermittent stoppage of the convoluted strip 32 by the cutting mechanism 72 for the cutting of the convoluted strip 32 to form the individual springs 10. The hump station 160 includes one or more air nozzles 162 receiving pressurized air from a source of pressurized air, not shown, to vertically displace a portion of the continuous convoluted strip 32. This humping of the convoluted strip 32 accommodates the temporary stopping of the convoluted strip for cutting purpose without requiring the forming rolls 36 and 38 to be stopped.

The details of the forming rolls 36 and 38 are shown in FIGS. 4 and 5. Forming rolls 36 and 38 have mating forming wheels 86. Forming roll 36 has a pair of end caps 88 attached on opposite sides of forming wheel 86 by a plurality of bolts 90. End caps 88 have a radial flange 92 adjacent to the forming wheel 86. Forming roll 38 has a pair of circular end caps 94 attached on opposite sides of its forming wheel 86 by a plurality of bolts 96. The end caps 94 each have a radial flange 98 on the sides adjacent to the forming wheel 86 which straddle radial flanges 92 when the teeth of the respective forming wheels are engaged. This arrangement assures the lateral alignment of the forming rolls 36 and 38.

FIG. 6 is a cross-sectional blow-up showing the formation of the convolutions in the strip 32 by the forming wheels 36 and 38 and the details of the forming wheel teeth and the stripper fingers 58 and 60. The teeth 50 and 52 of the forming wheels 36 and 38, respectively, have the same basic configuration as the initial convolutions on the convoluted spring 10 with the necessary tolerances and clearances such that the strip 32 has the desired contour. The teeth 50 and 52 shown in FIG. 6 are configured to coin the U-shaped crowns 12 and the transverse breakline 16, thereby forming the convoluted spring 10 shown in FIG. 1.

The invention is not limited to the specific contour of the convoluted spring shown in FIGS. 1 and 6, but is applicable to various other types of convoluted springs such as a convoluted spring in which the secondary bend is not required, the spring having more than one secondary bend or a spring which the legs are curved.

The stripper fingers 58 and 60 are received in the slots 54 and 56 and have concaved external surfaces 104 and 106, respectively, having radii of curvatures slightly larger than the radius of curvature at the bottom of the slots 54 and 56. As previously indicated, the internal surfaces 108 and 110 of the stripper fingers guide and confine the convoluted strip 32 in the region between the forming rolls 36 and 38 and the compression mechanism 72 illustrated as compression pads 64 and 66.

Figure 7:
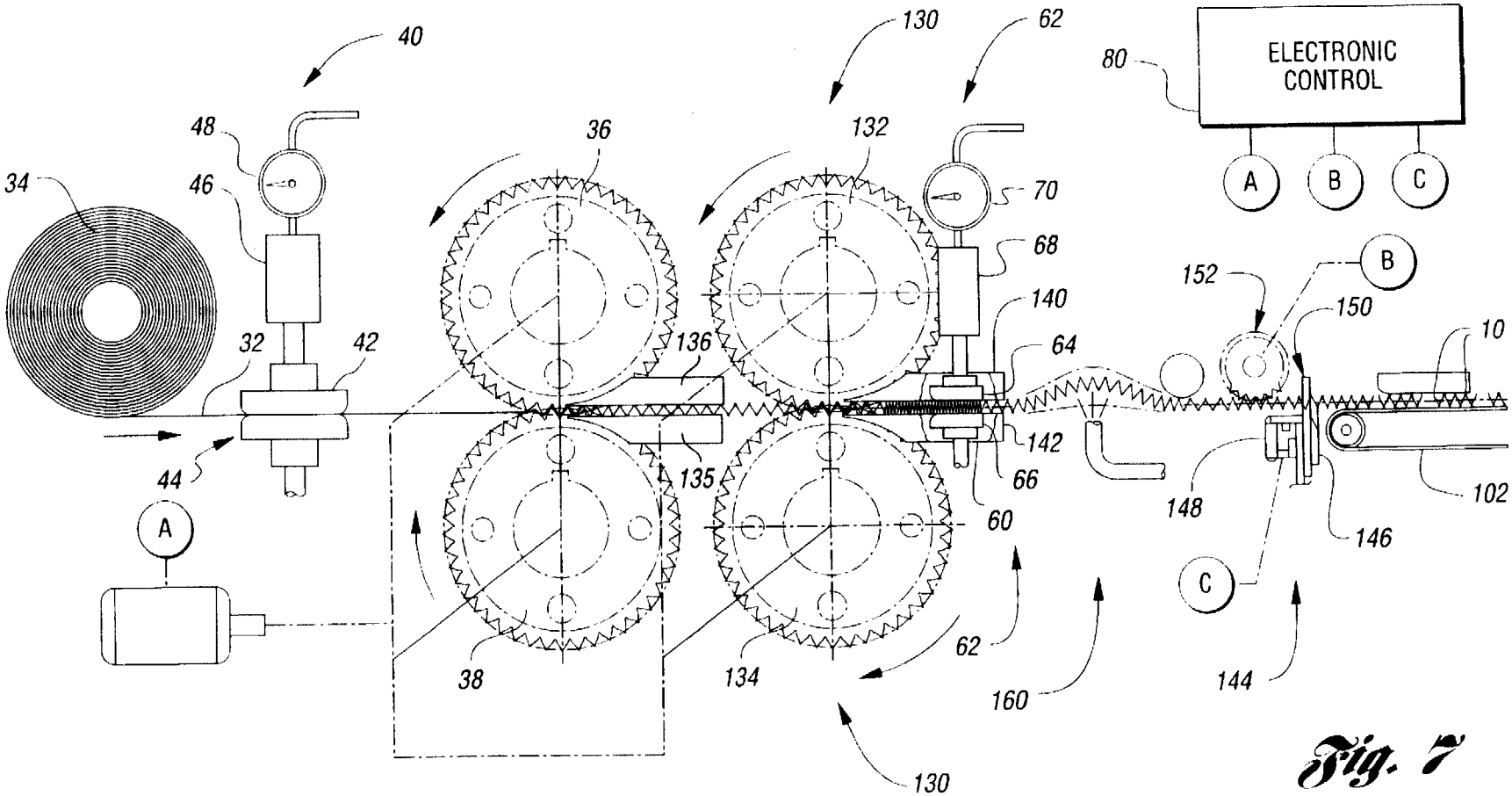
FIG. 7 is a side view of a second embodiment of the invention.

An alternative embodiment 130 of the spring making apparatus 30 is shown in FIG. 7, in the event the metal strip 32 is so narrow that the forming rolls 36 and 38 could not accommodate slots, such as slots 54 or 56 shown in FIG. 4. This embodiment is substantially the same as shown in FIG. 3, but further includes a pair of star wheels 132 and 134 disposed between the forming rolls 36 and 38 and the compression mechanism 62. A first set of stripper fingers 136 and 138 are disposed between the forming rolls 36 and 38 and the star wheels 132 and 134, which strips the convoluted strip from the forming rolls 36 and 38 and guide it to the star wheels. A second set of stripper fingers 140 and 142 strip the convoluted strip from the star wheels 132 and 134 and guide and confine the convoluted strip between the star wheels and the compression mechanism 62 as discussed relative to stripper fingers 58 and 60, shown in FIG. 3. The star wheels 132 and 134 have interleaved teeth which fit in the valleys of the convoluted metal strip and are preferentially rotated at the same speed as the forming rolls 36 and 38. The star wheels 132 and 134 may be narrower than the convoluted strip 32 since they perform no forming function and the stripper fingers may be positioned on the opposite sides of the star wheels.

The star wheels' primary function is to provide a force on the convoluted strip 32 to compress the convoluted metal strip in the compression mechanism 62.

As previously described relative to FIG. 3, the convoluted strip is extracted from the compression mechanism and fed into cutting device 74 where it is severed to form the desired convoluted springs 10.

The cutting mechanism may be the same as the cutting mechanism 74 shown in FIG. 2 or may be a shearing mechanism 144 as taught by Wallis in U.S. Pat. No. 5,261,262, issued on Nov. 16, 1993, which is incorporated herein by reference. The shearing mechanism 144 has a knife blade 146 which is driven by an electric motor 148 to move transversely relative to the convoluted web 32. At the top of its transverse movement, the knife blade 146 engages an apex of the convoluted strip and in cooperation with a shear block 150 severs the continuous convoluted strip 32 guillotine style into separate convoluted springs 10. A positioning roll 152 intermittently stops the forward motion of the convoluted strip to permit the shearing mechanism 144 to sever the individual springs 10 from the convoluted strip 32.

A humping station 160 such as shown in FIG. 3 may be included between the star wheels 132 and 134 and the positioning roll 152 to accommodate the periodic stopping of the positioning roll 152 during the shearing of the convoluted strip 32.

Figure 8:
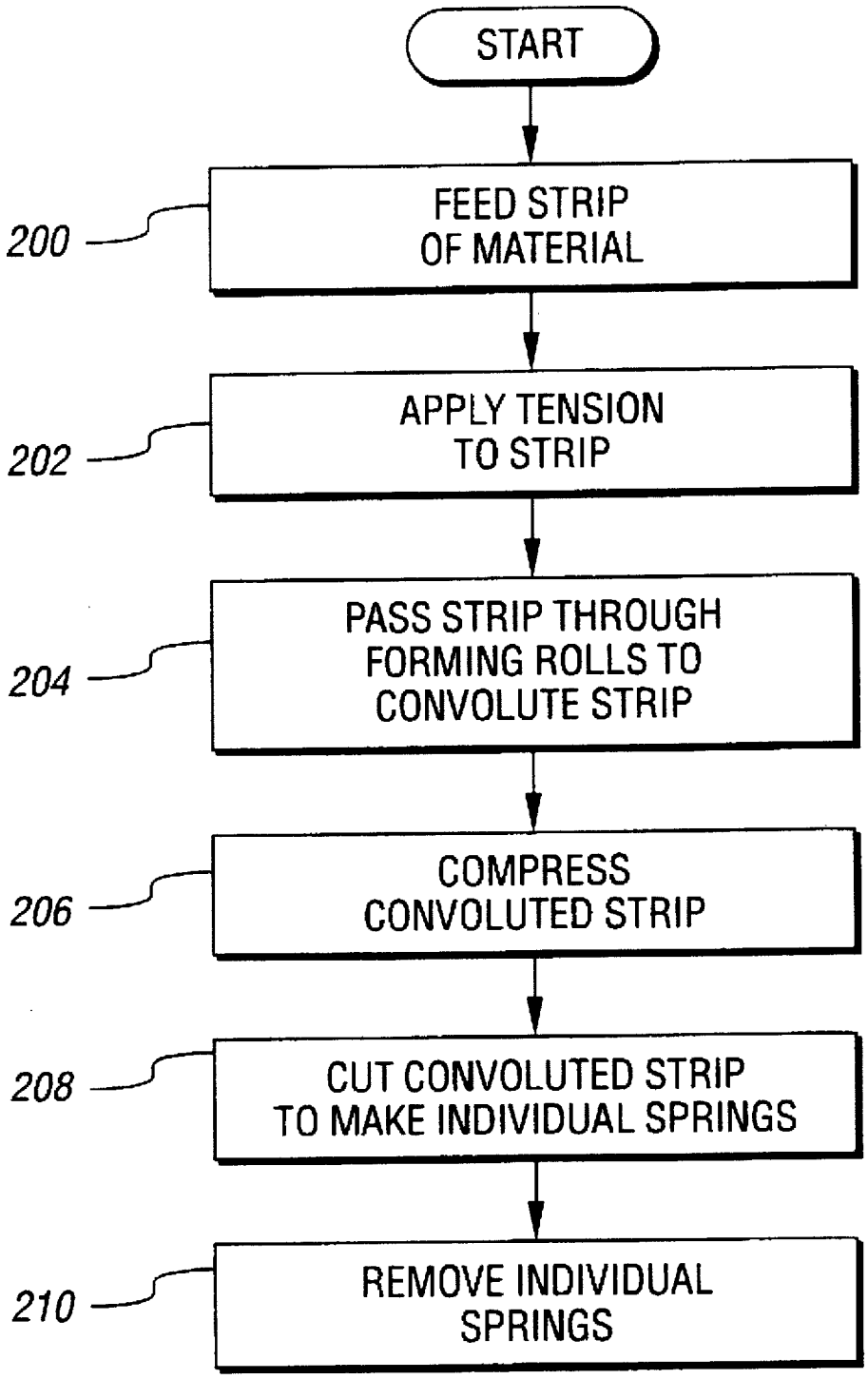
FIG. 8 is a flow diagram of the method for roll forming convoluted springs.

FIG. 8 is a flow diagram of the process for roll forming the convoluted springs 10 according to the invention. The process begins by feeding a strip of resilient deformable material into the spring forming rolls as indicated by block 200. Tension is then applied to the strip of resilient deformable material 32 as it enters between the forming rolls as indicated by block 202. The strip is then passed between the forming rolls to convolute the strip, as indicated by block 204. The convoluted metal strip is then passed directly into the compression mechanism where the convolutions are compressed, block 206. The compressed convoluted strip is then extracted from the compression mechanism and cut to the desired length to make individual convoluted springs, block 208. The convoluted springs 10 are then removed from the cutting device for use as desired as indicated by block 210.

The use of roll forming technology can increase convoluted spring production by a factor of 10 or more over convention stamping methods. For example, a die can stamp up to 300 convolutions per minutes while with the roll forming method up to 6075 convolutions per minute can be made using a spring forming roll having 45 teeth rotating at 135 revolutions per minute. Even at the slow speed of 135 revolutions per minute, the convolution production rate is 20 times faster than the stamping method resulting in a large saving of time and initial investment.

There is almost an infinite variety of spring designs capable of being made by the roll forming method. The spring design, shown in FIG. 1, illustrates but a single example of a spring design capable of being made using the roll forming apparatus depicted in the FIGS. 3 and 7 and discussed in the specification.

Having disclosed a preferred embodiment of the apparatus for roll forming convoluted springs, it is recognized that those skilled in the art may make certain changes and/or improvements to the apparatus described and illustrated herein, within the scope of the invention as set forth in the appended claims.

What is claimed is:

1. An apparatus for roll forming convoluted springs from a strip of resilient deformable material, comprising:

a pair of forming rolls having a common region of contact with each other for convoluting the strip of material to form a convoluted strip having a desired contour, each forming roll of said pair of forming rolls having a set of teeth which interweave with each other at a common region of contact;

a mechanism associated with each forming roll of said pair of forming rolls to form a convoluted strip having coined U-shaped crowns transverse to said strip, each U-shaped crown terminating in a transverse breakline to contain and control deformation upon compression;

means for rotating said pair of rolls in opposite directions; and a compression mechanism to compress said convoluted strip after it leaves the forming rolls so that adjacent legs of the convoluted strip, in a relaxed state, will have predetermined angular relationships.

2. The apparatus of claim 1 further comprising a cut-off mechanism disposed downstream of said compression mechanism for severing said convoluted strip to produce individual convoluted springs.

3. The apparatus of claim 2 wherein said cut-off mechanism comprises:

a cutting wheel having a plurality of teeth engageable with said convoluted strip downstream of said compression mechanism, said plurality of teeth receivable between adjacent crests of said convoluted strips, said cutting wheel having a plurality of slots provided at predetermined teeth intervals;

means for periodically rotating said cutting wheel through said predetermined teeth intervals so as to align each slot, one at a time, to have a predetermined location; and a saw operative to reciprocate relative to said predetermined location, said saw having a blade receivable in each of said slot each time one of said slots is in said predetermined location to cut said convoluted strips forming individual convoluted springs.

4. The apparatus of claim 3 further including a humping station disposed between said compression mechanism and said cut-off mechanism to accommodate the periodic rotation of said cutting wheel.

5. The apparatus of claim 4 further including at least one set of stripper fingers disposed between said pair of star wheels and said compression mechanism to guide and confine said convoluted strip during compression.

6. The apparatus of claim 2 wherein said cut-off mechanism comprises:

a positioning roll for periodically stopping said convoluted strip;

a knife blade displaceable to shear said convoluted strip; and means for coordinating the activation of said knife blade and said positioning roll so that continuous strip is severed by said knife blade when said convoluted strip is stopped by said positioning roll.

7. The apparatus of claim 5 further including a humping station disposed between compression mechanism and positioning roll to accommodate the periodic stopping of said convoluted strip by said positioning roll.

8. The apparatus of claim 2 further comprising a pair of the star wheels disposed between said forming rolls and said compression mechanism operative to meter said convoluted metal strip to said compression mechanism.

9. The apparatus of claim 8 further including a humping station disposed between said star wheel and said cut-off mechanism.

10. The apparatus of claim 1 further including a tension device disposed upstream of said pair of forming rolls to induce a tension in the strip of material before entering between said forming rolls.

11. The apparatus of claim 10 wherein said tensioning device comprises a pair of pressure pads engaging opposite faces of the strip of material to exert a frictional force placing a tension in said strip as it enters between the pair of forming rolls.

12. The apparatus of claim 1 further including at least one set of stripper fingers disposed between said pair of forming rolls and said compression mechanism to strip said convoluted strip from said forming rolls and to guide and confine said convoluted strip during compression.

13. The apparatus of claim 12 wherein said forming rolls include at least one annular groove sized to receive said at least one stripper finger.

14. The apparatus of claim 13 wherein said at least one annular groove is a pair of spatially separated annular grooves and wherein said at least one stripper finger is a pair of stripper fingers, one of said pair of stripper fingers being received in a respective one of said annular grooves.

15. The apparatus of claim 1 wherein one of said pair of forming rolls comprises:

a first forming wheel having a plurality of teeth disposed about its periphery, each tooth of said plurality of teeth contoured to produce a desired convolution in said strip of material; and a first pair of end caps attached to the opposite sides of said first forming wheel, each of said end caps having a radial flange adjacent the side opposite said first forming wheel; and wherein a second of said pair of forming rolls comprises:

a second forming wheel having a plurality of teeth disposed about its periphery, said plurality of teeth being contoured to mate with said first plurality of teeth; and a second pair of end caps attached to the opposite sides of said second forming wheel, each end cap of said second pair of end caps having a radial flange adjacent to said second forming wheel and adapted to be received between said radial flanges of said first pair of radial flanges when said teeth of said first forming wheel engage the teeth of said second forming wheel.

16. The apparatus of claim 15 wherein each of said first and second forming wheels have at least one annular groove.

17. The apparatus of claim 16 further including at least one stripper finger to facilitate the extraction of said convoluted strip from said forming rolls, said at least one stripper finger being receivable in said at least one annular groove, said at least one stripper finger guiding and confining said convoluted strip during compression.

18. The apparatus of claim 17 wherein said at least one annular groove is a pair of spatially separated annular grooves and said at least one stripper finger is a pair of stripper fingers, one stripper finger of said pair of stripper fingers being receivable in a respective one of said pair of annular grooves.

19. The apparatus of claim 17 wherein said stripper finger extends from said forming rolls to said compression mechanism to guide and confine said convoluted strip during compression.

20. The apparatus of claim 1 wherein said strip is a tempered steel strip.

21. A method for making convoluted springs from a strip of resilient deformable material, comprising the steps of:

feeding the strip of resilient deformable material between a pair of forming rolls;

convoluting and coining said strip of resilient deformable material by said pair of forming rolls to form a continuous convoluted strip with a U-shaped crown terminating at its opposite ends with a transverse breakline to said strip to contain and control deformation upon compression; and compressing said convoluted strip with a compressing mechanism to establish a predetermined angular relationship between the legs of the convoluted strip.

22. The method of claim 21 further including the step of severing said convoluted strip to produce individual convoluted springs having a predetermined number of convolutions.

23. The method of claim 22 wherein said step of severing comprises the steps of:

engaging said continuous convoluted strip with a slotted wheel having a plurality of teeth receivable between adjacent crests of said convoluted strip and a plurality of slots provided at predetermined teeth intervals;

stopping said slotted wheel each time one of said slots is at a location aligned with a blade of a cutting saw; and reciprocating said cutting saw to sever from said continuous strip individual convoluted springs in response to each time said cutting wheel is stopped.

24. The method of claim 22 wherein said step of severing comprises the steps of:

engaging said convoluted strip with a positioning wheel having a plurality of teeth receivable between adjacent crests of said convoluted strip;

periodically stopping said positioning wheel to align a knife edge with selected crests; and activating said knife blade to sever said selected crests to produce individual convoluted springs.

25. The method of claim 22 further comprising the step of humping said convoluted strip at a humping station prior to said step of severing to accommodate the periodic stopping of said positioning wheel.

26. The method of claim 21 further including the step of placing a tension on said strip of resilient deformable material as it is received between said pair of forming rolls.

27. The method of claim 21 further including the step of guiding and restraining said convoluted strip in the region between said pair of forming rolls and said compression mechanism.

28. The method of claim 21 further including the step of metering said continuous convoluted strip to said compression mechanism using a pair of star wheels.

* * * * *

UNITED STATES PATENT AND TRADEMARK OFFICE
CERTIFICATE OF CORRECTION

PATENT NO. : 5,732,584

DATED : March 31, 1998

INVENTOR(S) : LARRY P. PRATER

It is certified that error appears in the above-identified patent and that said Letters Patent is hereby corrected as shown below:

Column 6, Line 62, Claim 7: delete "5" and insert --6--.

Column 8, Line 51, Claim 26: delete "21" and insert --20--.

Signed and Sealed this

Twelfth Day of January, 1999

*Attest:*

*Attesting Officer*

*Acting Commissioner of Patents and Trademarks*